United States Patent [19]

Hibino et al.

[11] Patent Number: 4,705,011

[45] Date of Patent: Nov. 10, 1987

[54] AIR INTAKE SIDE SECONDARY AIR SUPPLY SYSTEM FOR AN INTERNAL COMBUSTION ENGINE WITH AN IMPROVED OPERATION FOR A LARGE AMOUNT OF THE SECONDARY AIR

[75] Inventors: Yoshitaka Hibino; Takeshi Fukuzawa; Hiromitsu Sato; Masahiko Asakura, all of Wako, Japan

[73] Assignee: Honda Giken Kogyo Kabushiki Kaisha, Tokyo, Japan

[21] Appl. No.: 916,228

[22] Filed: Oct. 7, 1986

[30] Foreign Application Priority Data

Oct. 9, 1985 [JP] Japan ..... 60-225815
Oct. 31, 1985 [JP] Japan ..... 60-245853

[51] Int. Cl.[4] ..... F02M 23/04
[52] U.S. Cl. ..... 123/589
[58] Field of Search ..... 123/585–589, 123/339

[56] References Cited

U.S. PATENT DOCUMENTS 4,335,699 6/1982 Totsune et al. ..... 123/588
4,356,797 11/1982 Matsui ..... 123/589
4,579,099 4/1986 Kishida et al. ..... 123/589
4,580,541 4/1986 Koumura ..... 123/587
4,586,481 5/1986 Kishida et al. ..... 123/589

*Primary Examiner*—William A. Cuchlinski, Jr.
*Attorney, Agent, or Firm*—Pollock, Vande Sande and Priddy

[57] ABSTRACT

An air intake side secondary air supply system for an internal combustion engine is provided with an open-close valve in an air intake side secondary air supply passage which is provided in addition to an air intake side secondary air supply passage for an air/fuel ratio control. The open-close valve is opened only when an amount of the secondary air through the passage for the air/fuel ratio control is higher than a predetermined level. In addition to the provision of the open-close valve, the opening of an open-close valve or a linear type solenoid valve wich is provided in the secondary air supply passage for controlling the air/fuel ratio is reduced, so that the valve operates in a range where the linearity of the operation of the valve is good. Thus, the accuracy of the air/fuel ratio control is improved especially when the amount of the secondary air is large.

2 Claims, 16 Drawing Figures

AIR INTAKE SIDE SECONDARY AIR SUPPLY SYSTEM FOR AN INTERNAL COMBUSTION ENGINE WITH AN IMPROVED OPERATION FOR A LARGE AMOUNT OF THE SECONDARY AIR

BACKGROUND OF THE INVENTION

1. Field of the Invention

The present invention relates to an air intake side secondary air supply system for an internal combustion engine, and more specifically to an air intake side secondary air supply system in which the accuracy of its operation when the amount of the secondary air is large is improved.

2. Description of Background Information

Air/fuel ratio feedback control systems for an internal combustion engine are known in which the oxygen concentration in the exhaust gas of the engine is detected by an oxygen concentration sensor (referred to as $O_2$ sensor hereinafter) and the air/fuel ratio of mixture to be supplied to the engine is feedback controlled in response to an output signal level of the $O_2$ sensor for the purification of the exhaust gas and improvements of the fuel economy. As an example of the air/fuel ratio feedback control system, an air-intake side secondary air supply system of a duty ratio control type is proposed, for example, in Japanese Patent Publication No. 55-3533 in which an open-close valve is disposed in an air intake side secondary air supply passage leading to a part of an intake manifold, downstream of a throttle valve of a carburetor, and a duty ratio of the open and close condition of the open-close valve, i.e. the supply of the air intake side secondary air, is feedback controlled in response to the output signal level of the $O_2$ sensor.

In such an air-intake side secondary air supply system of the duty ratio control type, the amount of the secondary air flowing through the open-close valve is saturated and changes very little with respect to the change in the control signal in a large range (90~100%, for example) of the duty ratio which indicates a time proportion of the opening of the open-close valve in each of the duty periods. Therefore, under such a condition, the amount of the secondary air does not necessarily correspond to the duty ratio of the control signal. Thus, with the conventional systems, the accuracy of the air/fuel ratio control may not be maintained when the duty ratio of the control signal is relatively large.

On the other hand, there is an air intake side secondary system in which a linear type solenoid valve is provided in the air intake side secondary air supply passage leading to the intake manifold. Such an air intake side secondary air supply system is disclosed, for example, in Japanese Patent Application laid-open No. 55-119941. In this system, an opening degree of the linear type solenoid valve is varies in response to the magnitude of a drive current supplied to its solenoid. With this solenoid valve, a sectional area of the air intake side secondary air supply passage is varied in response to a result of detection of the oxygen concentration in the exhaust gas.

In this type of air intake side secondary air supply system, the opening degree of the linear type solenoid valve does not vary precisely in proportion to the value of the drive current. Especially, in a range where the magnitude of the supplied current is large, the change in the opening degree of the solenoid valve per unit current value becomes small. Therefore, with conventional air/fuel ratio control systems of this type, the amount of the secondary air may deviate from the proper value, to reduce the accuracy of the air/fuel ratio control when the magnitude of the drive current to the linear type solenoid valve is large.

OBJECTS AND SUMMARY OF THE INVENTION

An object of the present invention is to provide a duty ratio control type air intake side secondary air supply system in which the accuracy of the air/fuel ratio control is improved in a range in which the duty ratio is large.

Another object of the present invention is to provide an air intake side secondary air supply system using a linear type solenoid valve for controlling the amount of the secondary air in which the accuracy of the air/fuel ratio control is improved, especially when the magnitude of the supply current is large.

According to the present invention, an air intake side secondary air supply system is provided with an air intake side secondary air supply passage having a second open-close solenoid valve, in addition to the air intake side secondary air supply passage in which a first open-close valve for the duty ratio control operation is provided. When a valve open time period calculated in response to an output signal of an oxygen concentration sensor (referred to as $O_2$ sensor hereinafter) is longer than a predetermined period, the second open-close valve is opened and at the same time the valve open time period is corrected so that it is reduced by an amount corresponding to an air flow through the second open-close valve when the latter is open. The first open-close valve is opened for the period of the corrected valve open period in the period of each duty cycle.

According to another aspect of the present invention, an air intake side secondary air supply system is provided with an air intake side secondary air supply passage with an open-close solenoid valve, in addition to the air intake side secondary air supply passage in which a linear type solenoid valve is provided. When a current value of the linear type solenoid valve determined in response to an output signal of an oxygen concentration sensor (referred to as $O_2$ sensor hereinafter) is higher than a predetermined value, the open-close valve is opened and at the same time the current value for the linear type solenoid valve is reduced by an amount corresponding to an air flow through the open-close valve when the latter is open.

BRIEF DESCRIPTION OF THE DRAWINGS

FIGS. 3, 4, 5A, 5B and 6 are flowcharts showing the manner of operation of a CPU 29 in the control circuit 20 in a first embodiment of the present invention, in which FIG. 3 shows a main routine, FIG. 4 shows an A/F routine, FIGS. 5A and 5B when combined show a $T_{ASQ}$ calculation subroutine, and FIG. 6 shows a $T_{OUT}$ determination subroutine;

FIGS. 10, 11A, 11B and 12 are flowcharts similar to FIGS. 4 through 6, showing the manner of operation of a CPU 29 in the control circuit 20' in the second embodiment of the present invention, in which FIG. 10 shows a main routine, FIGS. 11A and 11B when combined show a $D_{ASQ}$ calculation subroutine, and FIG. 12 shows a $D_{OUT}$ determination subroutine;

DETAILED DESCRIPTION OF THE PREFERRED EMBODIMENTS

Referring to the accompanying drawings, the first embodiment of the air intake side secondary air supply system according to the present invention will be explained hereinafter.

Figure 1:
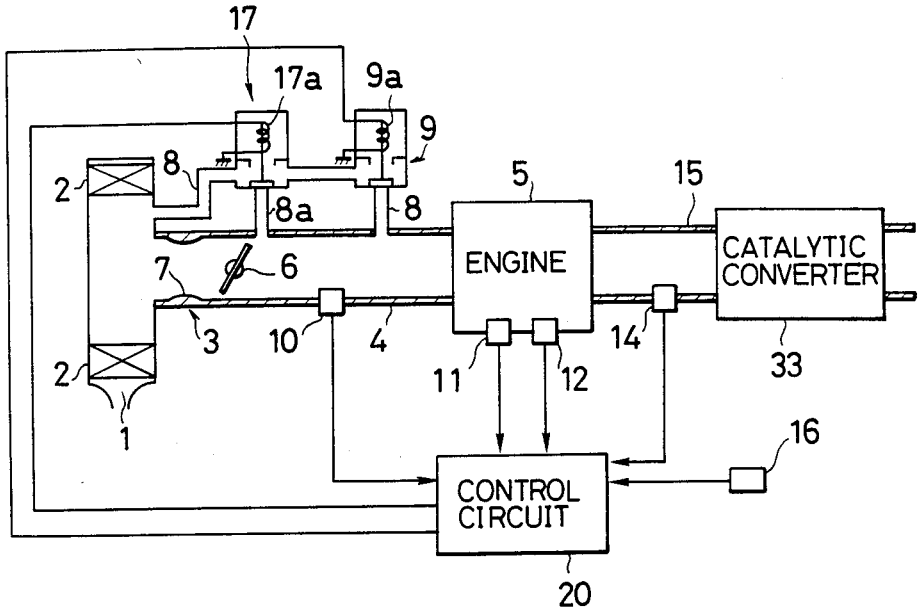
FIG. 1 is a schematic diagram showing a general construction of a first embodiment of an air intake side secondary air supply system according to the invention.

In FIG. 1 which illustrates a general construction of the air intake side secondary air supply system for an automotive internal combustion engine, intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. The inside of the air cleaner 2, near an air outlet port, communicates with the intake manifold 4 via an air intake side secondary air supply passage 8. The air intake side secondary air supply passage 8 is provided with a first open-close solenoid valve 9. Further, an air intake side secondary air supply passage 8*a* is provided which is branched off from the air intake side secondary air supply passage 8. In the air intake side secondary air supply passage 8*a*, there is provided a second open-close solenoid valve 17. The second open-close solenoid valve is, as in the case of the first open-close solenoid valve 9, opened by an application of a drive current to its solenoid 17*a*. Moreover, the air intake side secondary air supply passages 8 and 8*a* may be provided in parallel (separately from each other) to each other.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of cooling water of the engine 5, and an $O_2$ sensor 14 which is provided in an exhaust manifold 15 of the engine for generating an output signal whose level varies in response to the oxygen concentration in the exhaust gas. Further, a catalytic converter 33 for accelerating the reduction of the noxious components in the exhaust gas is provided in the exhaust manifold 15 at a location on the downstream side of the $O_2$ sensor 14. The first and second open-close solenoid valves 9 and 17, the absolute pressure sensor 10, the crank angle sensor 11, the engine cooling water temperature sensor 12, and the $O_2$ sensor 14 are electrically connected to a control circuit 20. Further, a vehicle speed sensor 16 which produces an output signal whose level is proportional to the speed of the vehicle is electrically connected to the control circuit 20.

Figure 2:
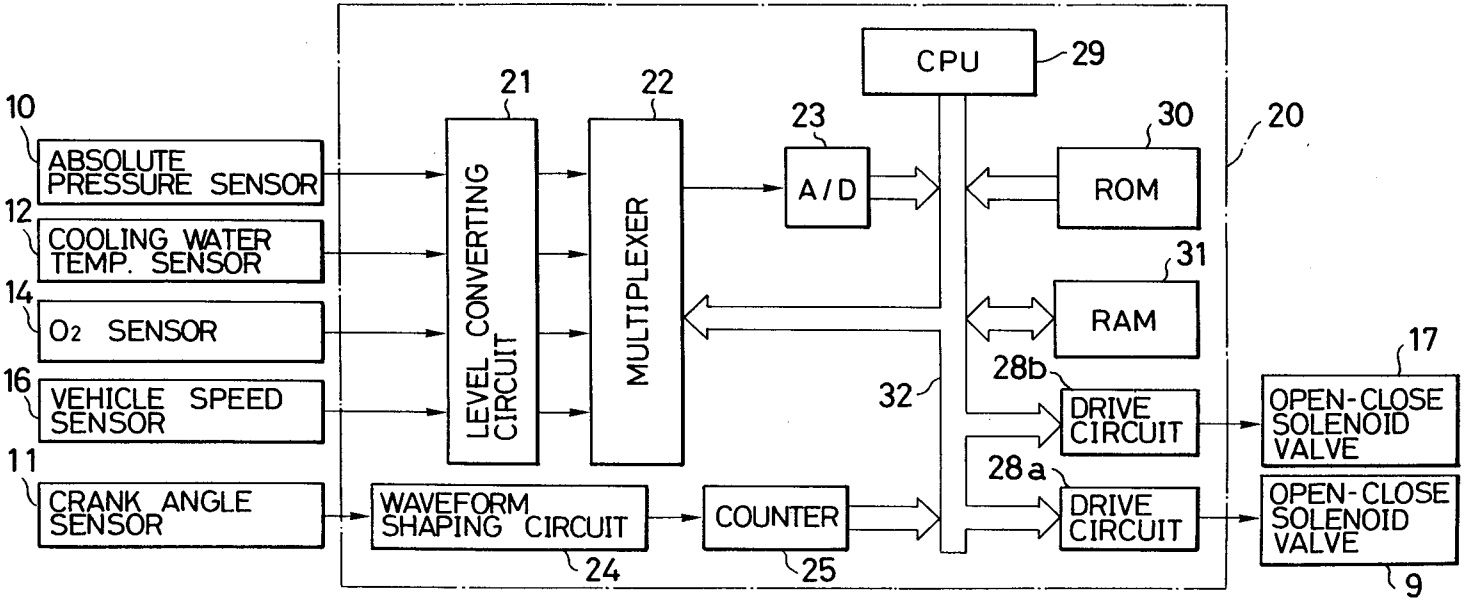
FIG. 2 is a block diagram showing the construction of the control circuit 20 of the system of FIG. 1.

FIG. 2 shows the construction of the control circuit 20. As shown, the control circuit 20 includes a level converting circuit 21 which effects a level conversion of the output signals of the absolute pressure sensor 10, the engine cooling water temperature sensor 12, the $O_2$ sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28*a* for driving the first open-close solenoid valve 9 in an opening direction, a drive circuit 28*b* for driving the second open-close solenoid valve 17 in an opening direction, a CPU (central processing unit) 29 which performs digital operations according to various programs, a ROM 30 in which various operating programs and data are previously stored, and a RAM 31. The multiplexer 22, the A/D converter 23, the counter 25, the drive circuits 28*a* and 28*b*, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, is selectively supplied from the A/D converter 23 to the CPU 29 via the input/output bus 32. Also information indicative of the engine speed from the counter 25 is supplied to the CPU 29 via the input/output bus 32. The CPU 29 is constructed to generate an internal interruption signal every one duty period $T_{SOL}$ (100 m sec, for instance). In response to this internal interruption signal, the CPU 29 performs an operation for the duty ratio control of the air intake side secondary air supply, explained hereinafter. Apart from the operation in response to the internal interruption signal, the CPU 29 determines whether or not the second open-close solenoid valve 17 is to be opened at intervals of a predetermined time period. When it is determined that the second open-close solenoid valve 17 is to be opened, the CPU provides a valve open command signal to the drive circuit 28*b* so that the second open-close solenoid valve 17 is opened.

Referring to the flowcharts of FIGS. 3 through 6, the operation of the air intake side secondary air supply system according to the present invention will be explained hereinafter.

Figure 3:
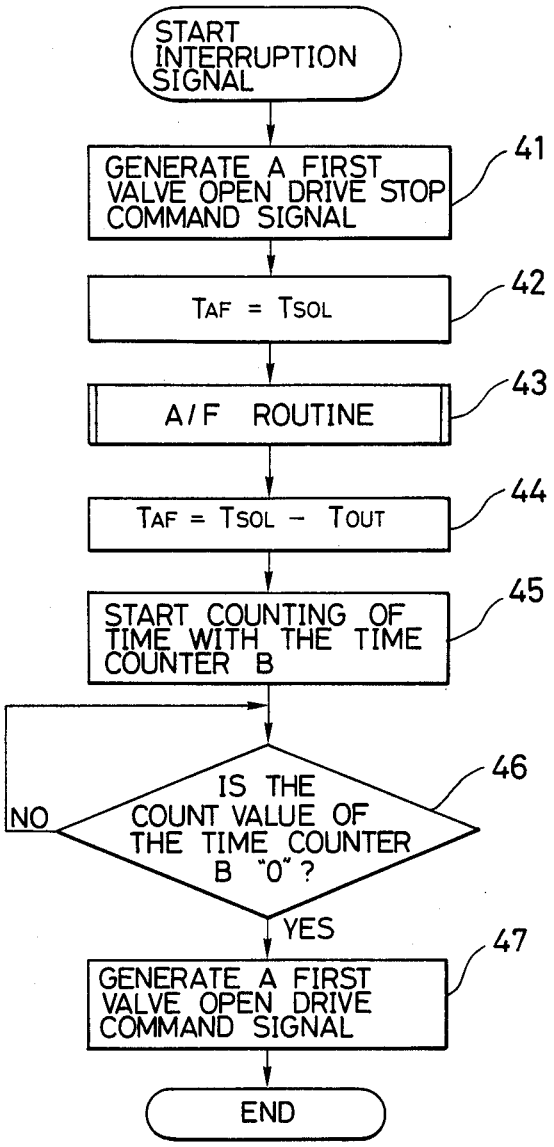
Figure 4:
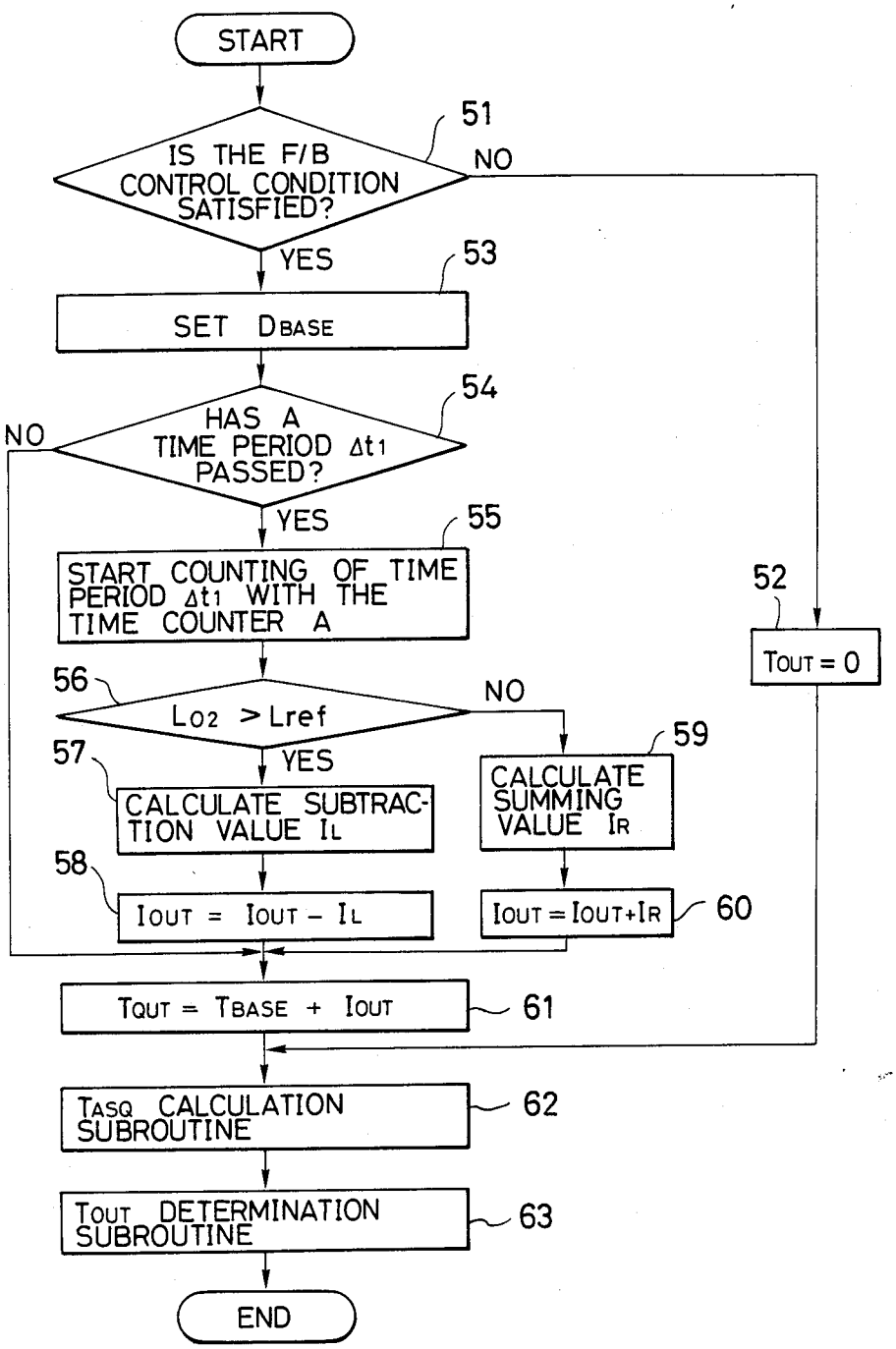

As shown in FIG. 3, at a step 41, a first valve open drive stop command signal is generated in the CPU 29 and supplied to the drive circuit 28a, at every time of the generation of the internal interruption signal in the CPU 29. With this signal, the drive circuit 28a is controlled to close the first open-close solenoid valve 9. This operation is provided so as to prevent malfunctions of the first open-close solenoid valve 9 during the calculating operation of the CPU 29. Next, a valve close period $T_{AF}$ of the first open-close solenoid valve 9 is made equal to a period of one duty cycle $T_{SOL}$ at a step 42, and an A/F routine for calculating a valve open period $T_{OUT}$ of the first open-close solenoid valve 9 which is shown in FIG. 4 is carried out through steps generally indicated at 43.

Figure 7:
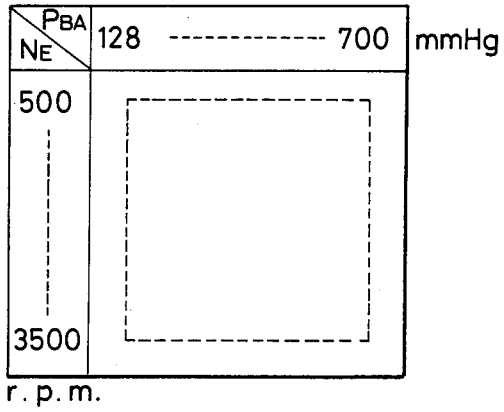
FIG. 7 is a diagram showing a $D_{BASE}$ data map which is previously stored in a ROM 30 of the control circuit 20.

In the A/F routine, whether or not the operating state of the vehicle (including operating states of the engine) satisfies a condition for the feedback (F/B) control is detected at a step 51. This detection is performed according to various parameters, i.e., absolute pressure within the intake manifold, engine cooling water temperature, vehicle speed, and engine rotational speed. For instance, when the vehicle speed is low, or when the engine cooling water temperature is low, it is determined that the condition for the feedback control is not satisfied. If it is determined that the condition for the feedback control is not satisfied, the valve open period $T_{OUT}$ is made equal to "0" at a step 52 to stop the air/fuel ratio feedback control. On the other hand, if it is determined that the condition for the feedback control is satisfied, the supply of the secondary air within the period of one duty cycle $T_{SOL}$, i.e., a period of base duty ratio (a base valve open time period) $D_{BASE}$ for the opening of the first open-close solenoid valve 9 is set at a step 53. Various values of the period of base duty ratio $D_{BASE}$ which are determined according to an absolute pressure within the intake manifold $P_{BA}$ and an engine speed $N_e$ are previously stored in the ROM 30 in the form of a $D_{BASE}$ data map as shown in FIG. 7, and the CPU 29 at first reads present values of the absolute pressure $P_{BA}$ and the engine speed $N_e$ and in turn searches a value of the period of base duty ratio $D_{BASE}$ corresponding to the read values from the $D_{BASE}$ date map in the ROM 30. Then, whether or not a count period of a time counter A incorporated in the CPU 29 (not shown) has reached a predetermined time period $\Delta t_1$ is detected at a step 54. This predetermined time period $\Delta t_1$ corresponds to a delay time from a time of the supply of the air intake side secondary air to a time in which a result of the supply of the air intake side secondary air is detected by the $O_2$ sensor 14 as a change in the oxygen concentration of the exhaust gas. When the predetermined time period $\Delta t_1$ has passed after the time counter A is reset to start the counting of time, the counter is reset again, at a step 55, to start the counting of time from a predetermined initial value. In other words, a detection as to whether or not the predetermined time period $\Delta t_1$ has passed after the start of the counting of time from the intital value by the time counter A, i.e. the execution of the step 55, is performed at the step 54.

After the start of the counting of the predetermined time period $\Delta t_1$ by the time counter A in this way, whether or not the output signal level $L_{O2}$ of the $O_2$ sensor 14 is greater than a reference value Lref corresponding to a target air fuel ratio is detected at a step 56. In other words, whether or not the air/fuel ratio of mixture is leaner than the target air/fuel ratio is detected at the step 56. The target air/fuel ratio is, for example, determined by using the absolute pressure value $P_{BA}$ and the engine speed $N_e$ to be greater than a stoichiometric air/fuel ratio. If $LO_2 > Lref$, it means that the air/fuel ratio of the mixture is leaner than the target air/fuel ratio, and a subtraction value $I_L$ is calculated at a step 57. The subtraction value $I_L$ is obtained by multiplication among a constant $K_1$, the engine speed $N_e$, and the absolute pressure $P_{BA}$, $(K_1 \cdot N_e \cdot P_{BA})$, and is dependent on the amount of the intake air of the engine 5. After the calculation of the subtraction value $I_L$, a correction value $I_{OUT}$ which is previously calculated by the execution of operations of the A/F routine is read out from a memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at a step 58.

On the other hand, if $LO_2 \leqq Lref$ at the step 56, it means that the air/fuel ratio is richer than the target air/fuel ratio. Then a summing value $I_R$ is calculated at a step 59. The summing value $I_R$ is calculated by a multiplication among a constant value $K_2$ ($\neq K_1$), the engine speed $N_e$, and the absolute pressure $P_{BA}$ $(K_2 \cdot N_e \cdot P_{BA})$, and is dependent on the amount of the intake air of the engine 5. After the calculation of the summing value $I_R$, the correction value $I_{OUT}$ which is previously calculated by the execution of the A/F routine is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at a step 60. After the calculation of the correction value $I_{OUT}$ at the step 58 or the step 60, the correction value $I_{OUT}$ and the period of base duty ratio $D_{BASE}$ set at the step 53 are added together, and a result of addition is used as the valve open period $T_{OUT}$ at a step 61. Then at a step 62, a subroutine for calculating a correction valve open period $T_{ASQ}$ for correcting the valve open period $T_{OUT}$ in response to the opening of the second open-close solenoid valve 17 is performed. Subsequently, a subroutine for determining an output valve open period $T_{OUT}$ is performed at a step 63.

Additionally, after the reset of the time counter A and the start of the counting from the initial value at the step 55, if it is detected that the predetermined time period $\Delta t_1$ has not yet passed, at the step 54, the operation of the step 61 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$ at a step 44. Subsequently, a value corresponding to the valve close period $T_{AF}$ is set in a time counter B incorporated in the CPU 29 (not shown), and down counting of the time counter B is started at a step 45. Then whether or not the count value of the time counter B has reached a value "0" is detected at a step 46. If the count value of the time counter B has reached the value "0", a first valve open drive command signal is supplied to the drive circuit 28a at a step 47. In accordance with this first valve open drive command signal, the drive circuit 28a operates to open the first open-close solenoid valve 9. The opening of the first open-close solenoid valve 9 is continued until a time at which the operation of the step 41 is performed again. If, at the step 46, the count value of the time counter B has not reached the value "0", the step 46 is executed repeatedly.

Thus, in the air intake side secondary air supply system according to the present invention, the first open-close solenoid valve 9 is closed immediately in response to the generation of the internal interruption signal INT, to stop the supply of the air intake side secondary air to the engine 5. When the valve close time $T_{AF}$ for the first open-close solenoid valve 9 within the period of one duty cycle $T_{SOL}$ is calculated and the valve close time $T_{AF}$ has passed after the generation of the interruption signal, the first open-close solenoid valve 9 is opened to supply the air intake side secondary air to the engine through the air intake side secondary air supply passage 8. Thus, the duty ratio control of the supply of the air intake side secondary air is performed by repeatedly executing these operations.

Figure 5A:
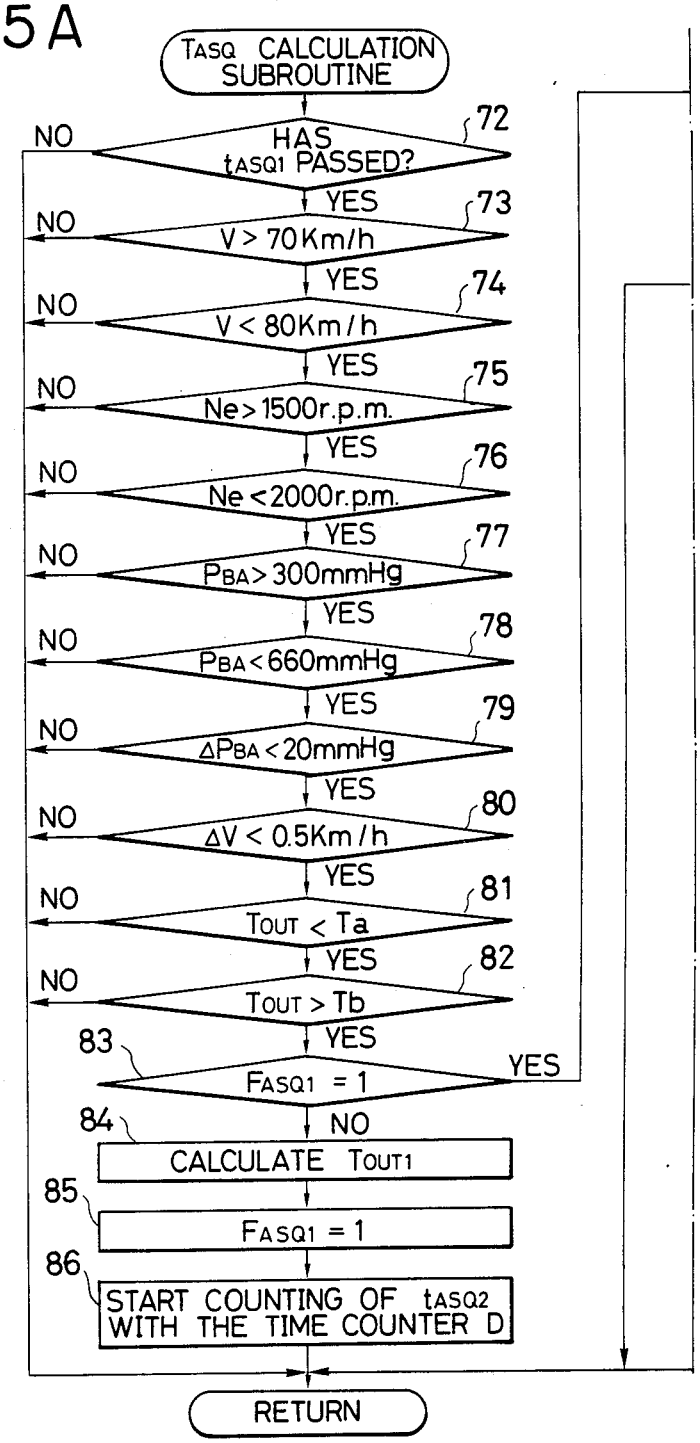
Figure 5:
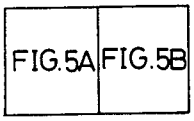
FIG. 5 is a diagram showing the juxtaposition of FIGS. 5A and 5B.
Figure 5B:
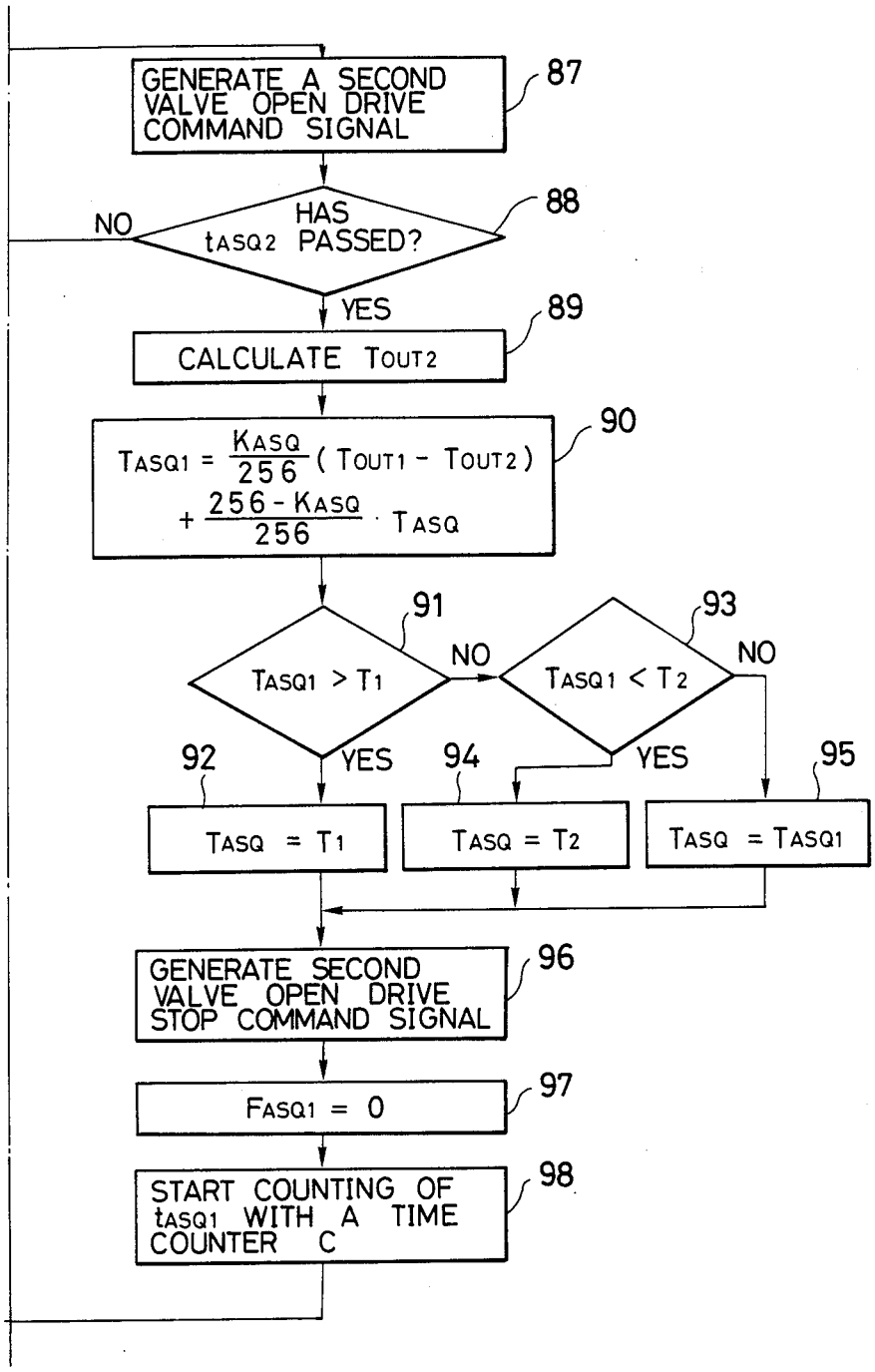

In the $T_{ASQ}$ calculation subroutine, as shown in FIGS. 5A and 5B, at first whether or not a predetermined time period $t_{ASQ1}$ has passed after the correction valve open period $T_{ASQ}$ was calculated by the operation of this routine, at a step 72. As will be described later, in this subroutine, the predetermined time period $t_{ASQ1}$ is set in a time counter C (not shown) provided in the CPU 29 and the down counting of the time counter C is started every time when the correction valve open period $T_{ASQ}$ is calculated. Therefore the elapse of the predetermined time period $t_{ASQ1}$ is determined by a count value of the time counter C. The correction valve open period $T_{ASQ}$ is initialized to a value $T_O$ upon application of the power current. When the predetermined time period $t_{ASQ1}$ has passed after the calculation of the correction valve open period $T_{ASQ1}$, whether or not the vehicle speed is higher than 70 km/h and lower than 80 km/h respectively, are detected at a step 73 and a step 74. Then whether or not the engine speed Ne is higher than 1500 r.p.m. and lower than 2000 r.p.m. respectively, are detected at a step 75 and a step 76. Subsequently, whether or not the absolute value $P_{BA}$ of the pressure in the intake manifold 4 is higher than 300 mmHg and lower than 660 mmHg respectively, are detected at a step 77 and a step 78. Then, whether or not a rate $\Delta P_{BA}$ of the change in the absolute pressure $P_{BA}$ per unit time is smaller than 20 mmHg per unit time is detected at a step 79. Similarly, whether or not an absolute value $\Delta V$ of a change in the vehicle speed per unit time is smaller than 0.5 km/h is detected at a step 80. Finally, whether or not the valve open period $T_{OUT}$ calculated at the step 61 is smaller than a predetermined value Ta and greater than a predetermined value Tb (Ta>Tb) respectively, are detected at a step 81 and a step 82.

These detections are provided so that a vehicle (including the engine) operation under a steady state is detected and so that a condition where the valve open period $T_{OUT}$ is long, is detected. When all of the following conditions: 70 km/h<V<80 km/h, 1500 r.p.m.<$N_e$<2000 r.p.m., 300 mmHg<$P_{BA}$<660 mmHg, $\Delta P_{BA}$<20 mmHg, $\Delta V$<0.5 km/h, and Tb<$T_{OUT}$<Ta, are satisfied, whether or not a flag $F_{ASQ1}$ indicating the opening or closing of the second open-close solenoid valve 17 is equal to "1" is detected at a step 83. If $F_{ASQ1}=0$, an average value $T_{OUT1}$ of values of the valve open period $T_{OUT}$ calculated at the step 61 within a predetermined time period (4 seconds, for example) is calculated at a step 84 since the second open-close solenoid valve 17 is closed at a step 96 which will be explained later. Then, a value "1" is set for the flag $F_{ASQ1}$ at a step 85, and a time period $t_{ASQ2}$ (4 seconds, for example) is set in a time counter D (not shown) in the CPU 29, to start the down counting of the time counter D, at a step 86. On the other hand, if $F_{ASQ1}=1$, the average value $T_{OUT1}$ of the valve open period $T_{OUT}$ when the second open-close solenoid valve 17 is close is already calculated, and a second valve open drive command signal is generated and supplied to the drive circuit **28*b* at a step 87. Then whether or not the time has elapsed more than the predetermined time period $t_{ASQ2}$ is determined by using a count value of the time counter D at a step 88. When the time has elapsed more than the time period $t_{ASQ2}$ after the second open-close solenoid value 17 is opened by the drive circuit 28*b* in response to the second valve open drive command signal, an average value $T_{OUT2}$ of values of the valve open period $T_{OUT}$ calculated at the step 61 within a time where the second open-close solenoid valve 17 is opened (4 seconds, for example) at a step 89**.

After the calculation of the average value $T_{OUT2}$, the correction valve open period $T_{ASQ1}$ is calculated, at a step 90, by calculating a weighted average of the average values $T_{OUT1}$ and $T_{OUT2}$. The calculation is performed by using the following equation:

$$T_{ASQ1}=K_{ASQ}(d\ OUT1-T_{OUT2})/256+(256-K_{ASQ})TASQ/256 \quad (1)$$

where $K_{ASQ}$ is a constant, and its value is 1, for example.

Then, at a step 91, whether or not the correction valve open period $T_{ASQ1}$ calculated by using the equation (1) is greater than a predetermined value $T_1$ (for example, a period corresponding to a duty ratio value 75%) is detected. If $T_{ASQ1}>T_1$, the correction value open period $T_{ASQ}$ is made equal to the predetermined value $T_1$ at a step 92. If $T_{ASQ1}\leqq T_1$, whether or not the correction valve open period $T_{ASQ1}$ is smaller than a predetermined value $T_2$ ($T_1>T_2$, for example, a period corresponding to a duty ratio value 65%) is detected at step 93. If $T_{ASQ1}<T_2$, the correction valve open time period TASQ is made equal to the predetermined value $T_2$ at a step 94. If, on the other hand, $T_{ASQ1}\geqq T_2$, the correction valve open time period $T_{ASQ}$ is made equal to the correction valve open time period $T_{ASQ1}$ at a step 95. After setting the correction valve open time period $T_{ASQ}$ in this way, a second valve open drive stop command signal is generated and supplied to the drive circuit **28*b* at a step 96, to close the second open-close solenoid valve 17. Then a value "0" indicating the closure of the second open-close solenoid valve 17 is set for the flag $F_{ASQ1}$ at a step 97. Further, a time period $t_{ASQ1}$ is set in a time counter C and the down counting of the time counter C is started at a step 98**.

Figure 6:
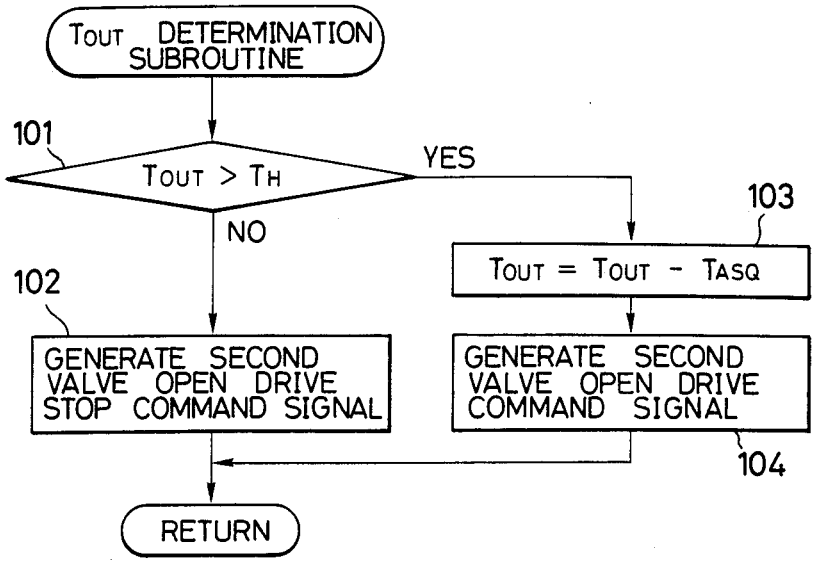

Next, in the $T_{OUT}$ determination subroutine, whether or not the valve open period $T_{OUT}$ calculated at the step 61 is greater than a predetermined value $T_H$ (for example, a period corresponding to a duty ratio value 90%) is detected at a step 101 as shown in FIG. 6. If $T_{OUT}\leqq T_H$, the second valve open drive stop command signal is generated and supplied to the drive circuit **28*b*, to close the second open-close solenoid valve 17, at a step 102. If, on the other hand, $T_{OUT}>T_H$, the valve open period $T_{OUT}$ is determined by subtracting the correction valve open period $T_{ASQ}$ set at the TASQ subroutine from the valve open period $T_{OUT}$, at a step 103. Then the second valve open drive command signal is generated and supplied to the drive circuit 28*b* at a step 104, to open the second open-close solenoid valve 17**.

Thus, in this embodiment of the air intake side secondary air supply system according to the present invention, the period of base duty ratio $D_{BASE}$ set at the step 53 is corrected in response to the output signal level of the $O_2$ sensor, to calculate the valve open period in the predetermined period $T_{SOL}$ at the step 61. When the valve open period $T_{OUT}$ is smaller than the predetermined value $T_H$, the valve open period $T_{OUT}$ is maintained as it is, and the second open-close solenoid valve 17 is closed. On the other hand, if the valve open period $T_{OUT}$ calculated at the step 61 is greater than the predetermined value $T_H$, the second open-close solenoid valve 17 is opened, and the valve open period is determined by subtracting the correction valve open period $T_{ASQ}$ set at the $T_{ASQ}$ calculation subroutine from the calculated valve open period $T_{OUT}$. By the operation of the drive circuit 28*a*, the solenoid 9*a* is energized to open the first open-close solenoid valve 9 for the valve open period $T_{OUT}$ in each of the predetermined periods $T_{SOL}$. By the opening of the first open-close solenoid valve 9, the secondary air is supplied into the intake manifold 4. When the valve open period $T_{OUT}$ is greater than the predetermined value $T_H$, the secondary air is also supplied through the second open-close solenoid valve 17 by its opening, in addition to the first open-close solenoid valve 9, into the intake manifold 4, so that the amount of the supply of the secondary air becomes proportional to the valve open period $T_{OUT}$ calculated at the step 61.

As will be appreciated from the foregoing, in the first embodiment according to the present invention, the air intake side secondary air supply system is provided with the second open-close valve in an air intake side secondary air supply passage which is different from the air intake side secondary air supply passage in which the first open-close valve for the duty ratio control is provided. When the valve open period of the first open-close valve in each of the predetermined periods of the duty cycle, determined in response to the output signal level of the $O_2$ sensor is lower than the predetermined value, the calculated valve open period is maintained as it is. When, on the other hand, the calculated valve open period is greater than the predetermined value, the second open-close valve is opened and the valve open period is determined by subtracting a value responsive to an amount of flow under the condition where the second open-close valve is open, from the calculated valve open period. In this way, the first open-close valve is opened for the period determined at an interval of the predetermined period, and the first open-close valve for duty control is operated within a range in which its linearity is good, even under an engine operational range where the duty ratio of the control signal become large. Thus, the supply of the secondary air is properly performed and the accuracy of the air/fuel ratio control is by far improved. Moreover, the efficiency of the purification of the exhaust gas is also improved.

Turning to FIGS. 8 through 14, the second embodiment of the air intake side secondary system will be explained hereinafter.

Figure 8:
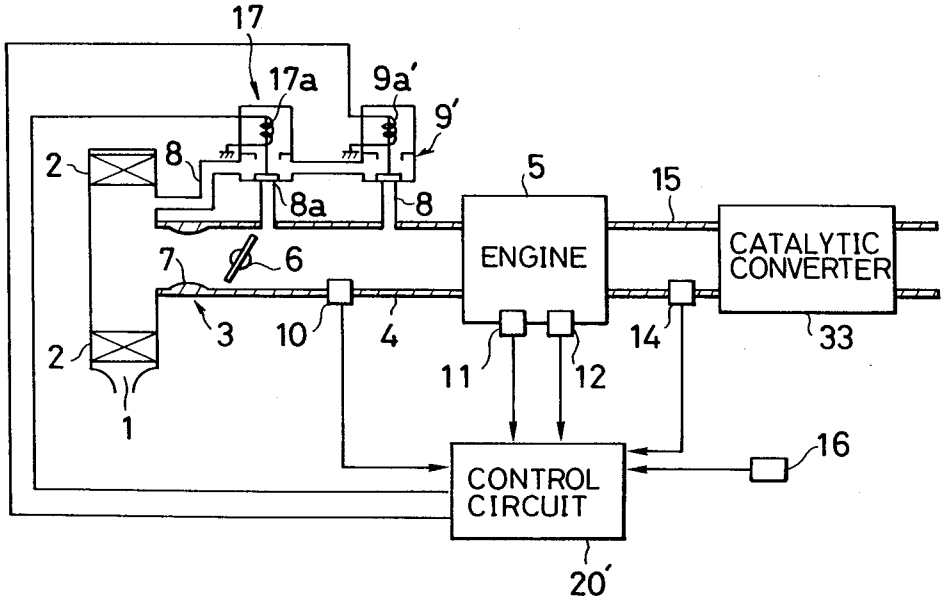
FIG. 8 is a a schematic diagram similar to FIG. 1, showing a general construction of a second embodiment of the air intake side secondary air supply system according to the invention.

As shown in FIG. 8, the basic construction of the system is identical with the system shown in FIG. 1 except that a linear type solenoid valve 9' having a solenoid 9*a'* is provided in place of the open/close solenoid valve 9. The opening degree of the solenoid valve 9' is varied in response to the magnitude of a current supplied to the solenoid 9*a'*. Further, the control circuit is denoted by 20' since its operation is slightly different from that of the control circuit 20 in FIG. 1. The reference numeral 17 denotes an open-close solenoid valve which is the same as the second open-close solenoid valve 17 in FIG. 1, however; this valve 17 is denoted simply as the open-close solenoid valve in this embodiment. Since the construction and the operation of the other parts shown in FIG. 8 are the same as those of the parts shown in FIG. 1, the explanation thereof will not be repeated.

Figure 9:
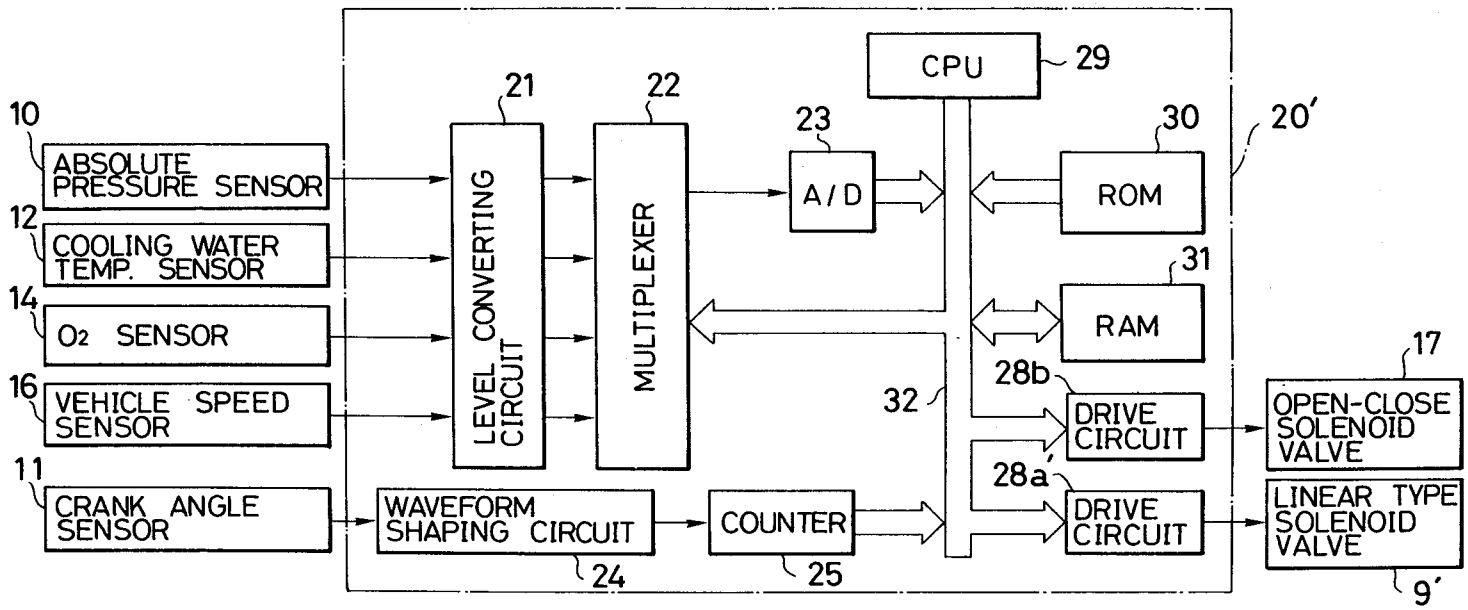
FIG. 9 is a block diagram showing the construction of the control circuit 20' of the system of FIG. 8.

FIG. 9 shows the construction of the control circuit 20' which controls the linear type solenoid valve 9' and the open-close solenoid valve 17. The construction of the control circuit 20' is substantially the same as the construction of the control circuit 20 shown in FIG. 2. It is to be noted, however, that a drive circuit 28*a'* different from the drive circuit 28*a* shown in FIG. 2 is provided and the solenoid 9*a'* of the solenoid valve 9' is connected in series with a drive transistor (not shown) of the drive circuit 28*a'* and a resistor for detecting a current value (also not shown). A power voltage is supplied across two terminals of this series circuit.

The operation of the CPU 29 of the control circuit 20' will be explained hereinafter.

At first, the CPU 29 produces internal interruption signals as in the case of the first embodiment. In response to this internal interruption signal, the CPU 29 provides a current supply value $D_{OUT}$ for the solenoid 9*a'* of the solenoid 9' and supplies it to the drive circuit 28*a'*. The drive circuit 28*a'* performs a closed loop control operation so that the magnitude of current flowing through the solenoid 9*a'* becomes equal to the current supply value $D_{OUT}$. Apart from the operation in response to the internal interruption signal, the CPU 29 determines whether or not the open-close solenoid valve 17 is to be opened at intervals of a predetermined time period as in the case of the previous embodiment. When it is determined that the open-close solenoid valve 17 is to be opened, the CPU 29 provides a valve open command signal to the drive circuit 28*b* so that the open-close solenoid valve 17 is opened.

Figure 10:
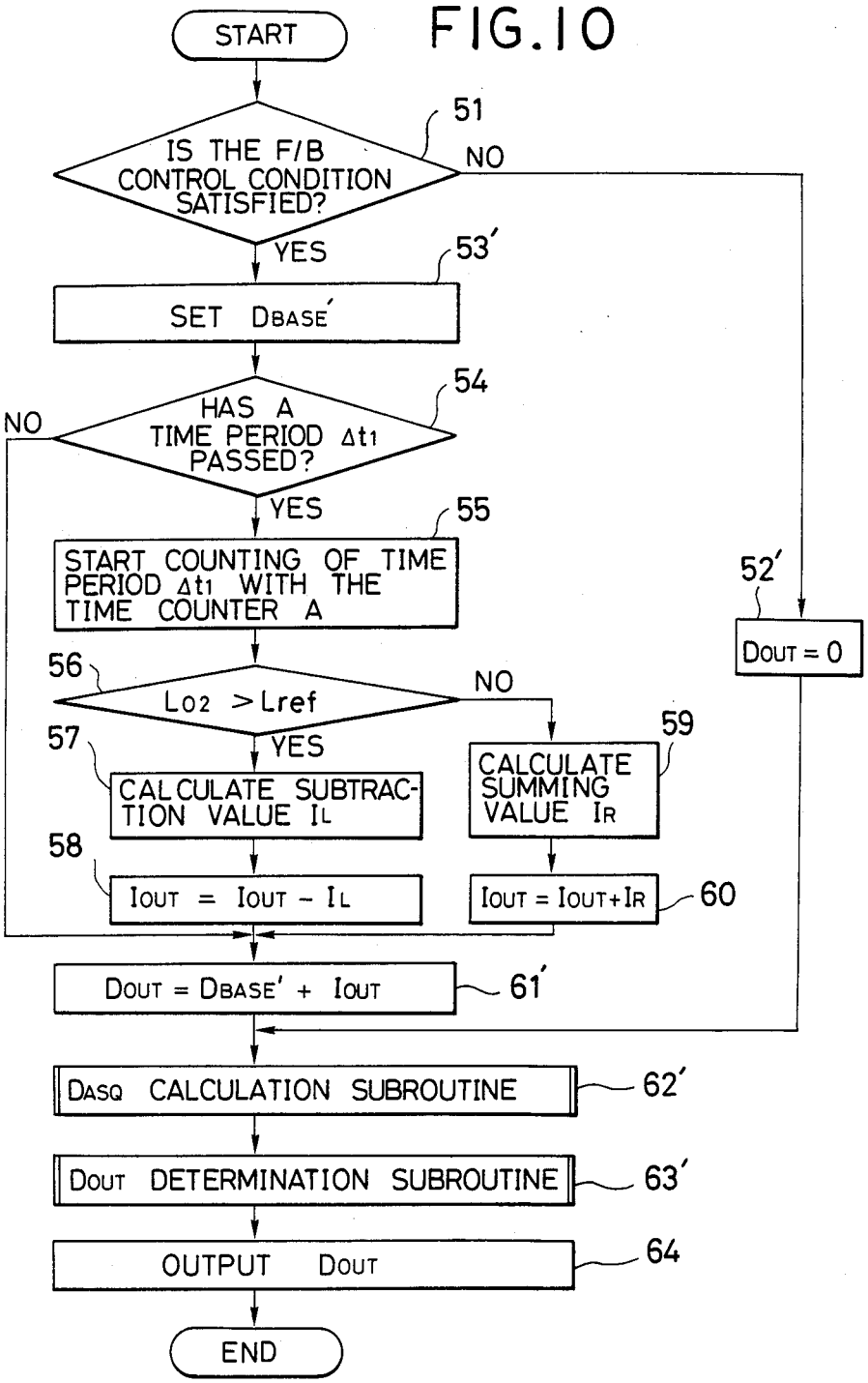
Figure 13:
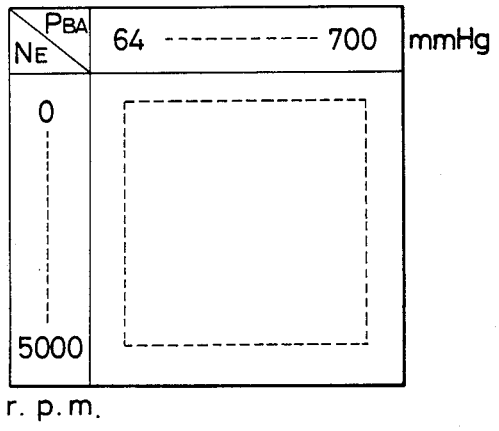
FIG. 13 is a diagram showing a $D_{BASE}$, data map which is previously stored in a ROM 30 of the control circuit 20'.

As shown in FIG. 10, whether or not the operating state of the vehicle (including operating states of the engine) satisfies the condition for the feedback (F/B) control is detected at a step 51 as in the A/F routine of the previous embodiment. If it is determined that the condition for the feedback control is not satisfied, the current supply value $D_{OUT}$ is made equal to "0" at a step 52' to stop the air/fuel ratio feedback control. On the other hand, if it is determined that the condition for the feedback control is satisfied, a base value $D_{BASE'}$ of the current to be supplied to the solenoid valve 9' is set at a step 53'. Various values of the base value $D_{BASE'}$ which are determined according to the absolute pressure within the intake manifold $P_{BA}$ and the engine speed $N_e$ are previously stored in the ROM 30 in the form of a $D_{BASE'}$ data map as shown in FIG. 13, and the CPU 29 at first reads present values of the absolute pressure $P_{BA}$ and the engine speed $N_e$ and in turn searches a value of the base value $D_{BASE'}$ corresponding to the read values from the $D_{BASE'}$ date map in the ROM 30. After the setting of the base current value, whether or not the count period of the time counter A incorporated in the CPU 29 (not shown) has reached the predetermined time period $\Delta t_1$ is detected at the step 54. When the predetermined time period $\Delta t_1$ has passed after the time counter A is reset to start the counting of time, the counter is reset again, at the step 55, to start the counting of time from the predetermined initial value. After the start of the counting of the predetermined time period $\Delta t_1$ by the time counter A in this way, whether or not the output signal level of the $O_2$ sensor 14 is greater than the reference value Lref corresponding to the target air/fuel ratio is detected at the step 56. In other words, whether or not the air/fuel ratio of mixture is leaner than the target air/fuel ratio is detected at the step 56.

If $LO_2 > Lref$, it means that the air/fuel ratio of the mixture is leaner than the target air/fuel ratio, and the subtraction value $I_L$ is calculated at the step 57. After the calculation of the subtraction value $I_L$, the correction value $I_{OUT}$ which is previously calculated by the execution of operations of this routine is read out from the memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at the step 58. On the other hand, if $LO_2 \leqq Lref$ at the step 56, it means that the air/fuel ratio is richer than the target air/fuel ratio. Then the summing value $I_R$ is calculated at the step 59. After the calculation of the summing value $I_R$, the correction value $I_{OUT}$ which is previously calculated by the execution of the A/F routine is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at the step 60. After the calculation of the correction value $I_{OUT}$ at the step 58 or the step 60, the correction value $I_{OUT}$ and the base value $D_{BASE}$ set at the step 53' are added together, and a result of addition is made as the current supply value $D_{OUT}$ at a step 61'. Then a subroutine for determining a correction current value $D_{ASQ}$ for correcting the current supply value $D_{OUT}$ when the open-close solenoid valve 17 is open, is performed at a step 62'. Then a subroutine for determining $D_{OUT}$ is executed at a step 63'. After the determination of the current supply value $D_{OUT}$, the current supply value $D_{OUT}$ is supplied to the drive circuit 28a' at a step 64.

Figure 14:
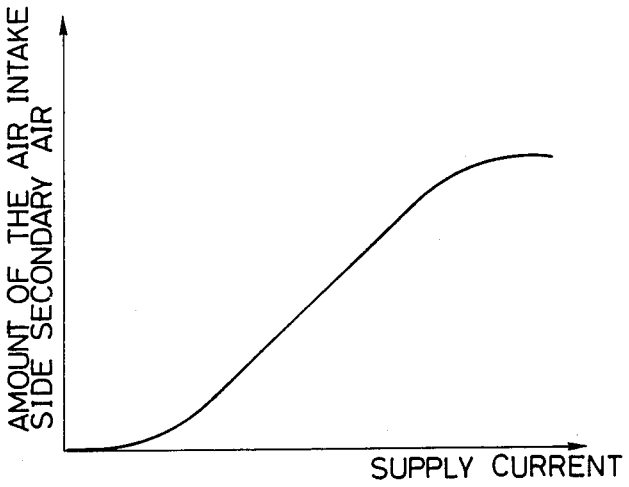
FIG. 14 is a diagram showing a relationship between a magnitude of a current supplied to the solenoid valve 9' and an amount of the secondary air in the second embodiment of the present invention.

The drive circuit 28a' operates as follows. At first the magnitude of the current flowing through the solenoid 9a' of the solenoid valve 9' is detected. Then the detected manitude of the current is compared with the current supply value $D_{OUT}$ and the aforementioned drive transistor is on-off controlled in response to a result of the comparison, to supply the drive current to the solenoid 9a'. Thus, the current flowing through the solenoid 9a' becomes equal to the current supply value $D_{OUT}$. In this way, the secondary air whose amount varies in proportion to the change in the magnitude of the current flowing through the solenoid 9a' of the solenoid valve 9' is supplied to the intake manifold 4 as shown in FIG. 14.

Additionally, after the reset of the time counter A and the start of the counting from the initial value at the step 55, if it is detected that the predetermined time period $\Delta t_1$ has not yet passed, at the step 54, the operation of the step 61' is immediately executed as in the case of the previous embodiment. In this case, the correction value $I_{OUT}$ calculated by the routine up to the previous cycle is read out.

Figure 11A:
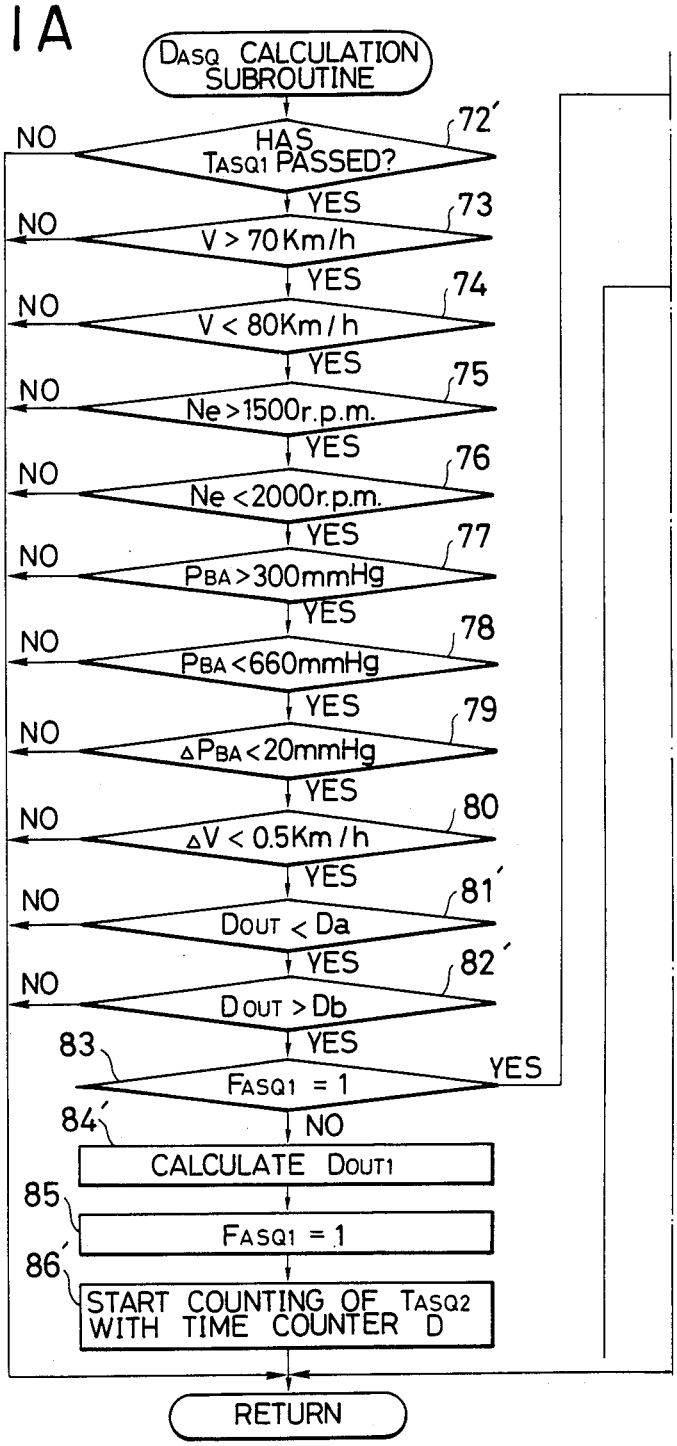
Figure 11:
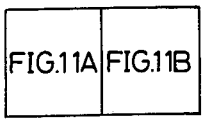
FIG. 11 is a diagram showing the juxtaposition of FIGS. 11A and 11B.
Figure 11B:
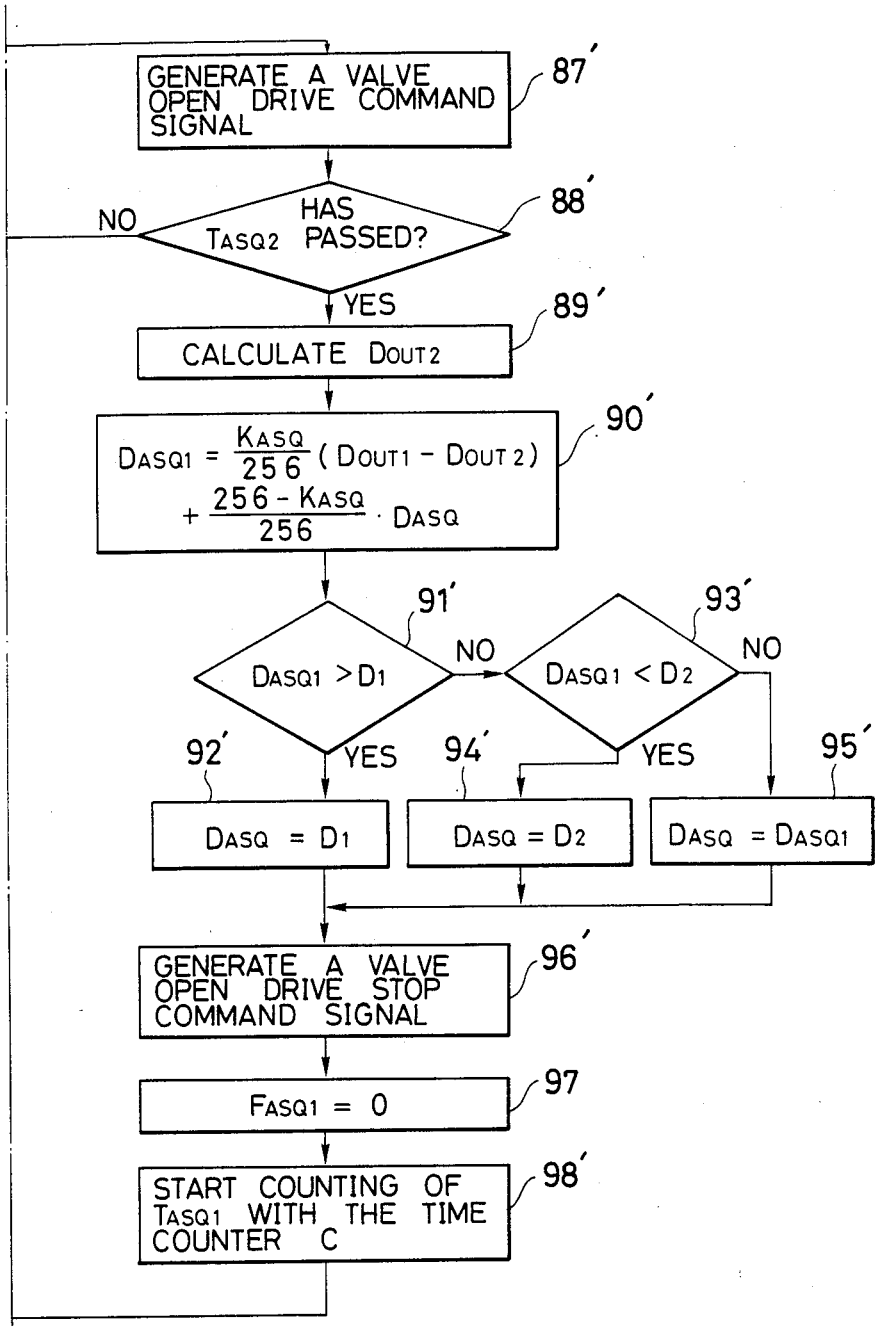

In the $D_{ASQ}$ calculation subroutine, as shown in FIGS. 11A and 11B, at first whether or not a predetermined time period $T_{ASQ1}$ has passed after the correction current value $D_{ASQ}$ was calculated by the operation of this routine, at a step 72'. As will be described later, in this subroutine, the predetermined time period $T_{ASQ1}$ is set in the time counter C (not shown) provided in the CPU 29 and the down counting of the time counter C is started every time when the correction current value $D_{ASQ}$ is calculated. Therefore the elapse of the predetermined time period $T_{ASQ1}$ is determined by a count value of the time counter C. The correction current value $D_{ASQ}$ is initialized to a value $D_O$ upon application of the power current.

In this subroutine, the operation of the steps 73 through 80 of the subroutine of the previous embodiment shown in FIG. 5A are also performed. The explanation thereof will not be repeated.

After the operation of the step 80, whether or not the current supply value $D_{OUT}$ calculated at the step 61' is smaller than a predetermined value Da and greater than a predetermined value Db (Da>Db) respectively, are detected at a step 81' and a step 82'. These detections are provided so that a vehicle (including the engine) operation under a steady state is detected and so that a condition where the current supply value $D_{OUT}$ is large, is detected. When all of the following conditions: 70 km/h<V<80 km/h, 1500 r.p.m.<$N_e$<2000 r.p.m., 300 mmHg<$P_{BA}$<660 mmHg, $\Delta P_{BA}$<20 mmHg, $\Delta V$<0.5 km/h, and Db<$D_{OUT}$<Da, are satisfied, whether or not the flag $F_{ASQ1}$ indicating the opening or closing of the open-close solenoid valve 17 is equal to "1" is detected at the step 83. If $F_{ASQ1}=0$, an average value $D_{OUT1}$ of values of the current supply value $D_{OUT}$ calculated at the step 61' within a predetermined time period (4 seconds, for example) is calculated at a step 84' since the open-close solenoid valve 17 is closed at a step 96' which will be explained later. Then, a value "1" is set for the flag $F_{ASQ1}$ at a step 85, and a time period $T_{ASQ2}$ (4 seconds, for example) is set in the time counter D (not shown) in the CPU 29, to start the down counting of the time counter D, at a step 86'. On the other hand, if $F_{ASQ1}=1$, the average value $D_{OUT1}$ of the current supply value $D_{OUT}$ when the open-close solenoid valve 17 is close is already calculated, and a valve open drive command signal is generated and supplied to the drive circuit 28b at a step 87'. Then whether or not the time has elapsed more than the predetermined time period $T_{ASQ2}$ is determined by using a count value of the time counter B at a step 88'. When the time has elapsed more than the time period $T_{ASQ2}$ after the open-close solenoid value 17 is opened by the drive circuit 28b in response to the second valve open drive command signal, an average value $D_{OUT2}$ of values of the current supply value $D_{OUT}$ calculated at the step 61' within a time where the open-close solenoid valve 17 is opened (4 seconds, for example) at a step 89'.

After the calculation of the average value $D_{OUT2}$ the correction valve open period $D_{ASQ1}$ is calculated, at a step 90', by calculating a weighted average of the average values $D_{OUT1}$ and $D_{OUT2}$. The calculation is performed by using the following equation:

$$D_{ASQ1}=K_{ASQ}(D_{OUT1}-D_{OUT2})/256+(256-K_{ASQ})D_{ASQ}/256 \quad (2)$$

where $K_{ASQ}$ is a constant, and its value is 1, for example.

Then, at a step 91', whether or not the correction current value $D_{ASQ1}$ calculated by using the equation (2) is greater than a predetermined value $D_1$ is detected.

If $D_{ASQ1} > D_1$, the correction current value $D_{ASQ}$ is made equal to the predetermined value $D_1$ at a step 92'. If $D_{ASQ1} < D_1$, whether or not the correction current value $D_{ASQ1}$ is smaller than a predetermined value $D_2$ ($D_1 > D_2$) is detected at as step 93'. If $D_{ASQ1} < D_2$, the correction current value DASQ is made equal to the predetermined value $D_2$ at a step 94'. If, on the other hand, $D_{ASQ1} \geqq D_2$, the correction current value $D_{ASQ}$ is made equal to the correction current value $D_{ASQ1}$ at a step 95'. After setting the correction current value $D_{ASQ}$ in this way, a valve open drive stop command signal is generated and supplied to the drive circuit 28b at a step 96', to close the open-close solenoid valve 17. Then a value "0" indicating the closure of the open-close solenoid valve 17 is set for the flag $F_{ASQ1}$ at a step 97. Further, a time period $T_{ASQ1}$ is set in the time counter C and the down counting of the time counter C is started at a step 98'.

Figure 12:
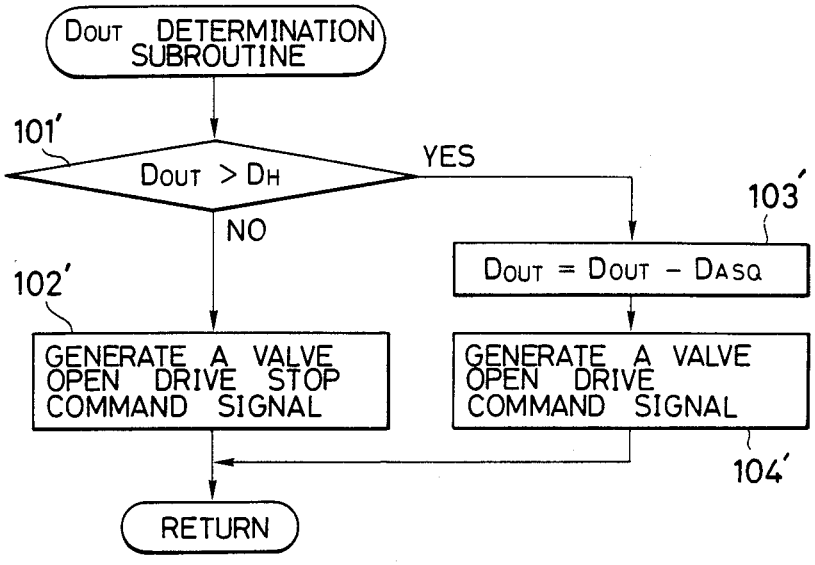

Next, in the $D_{OUT}$ determination subroutine, whether or not the current supply value $D_{OUT}$ calculated at the step 61' is greater than a predetermined value $D_H$ is detected at a step 101' as shown in FIG. 12. If $D_{OUT} \leqq D_H$, the valve open drive stop command signal is generated and supplied to the drive circuit 28b, to close the open-close solenoid valve 17, at a step 102'. If, on the other hand, $D_{OUT} > D_H$, the current supply value $D_{OUT}$ is determined by subtracting the correction current value $D_{ASQ}$ set at the DASQ subroutine from the current supply value $D_{OUT}$, at a step 103'. Then the valve open drive command signal is generated and supplied to the drive circuit 28b at a step 104', to open the open-close solenoid valve 17.

Thus, in this embodiment of the air intake side secondary air supply system according to the present invention, the base value $D_{BASE'}$ of the current value set at the step 53' is corrected in response to the output signal level of the $O_2$ sensor, to calculate the current supply value $D_{OUT}$ to the linear type solenoid valve. When the current supply value $D_{OUT}$ is smaller than the predetermined value $D_H$, the open-close solenoid valve 17 is closed. On the other hand, if the calculated current supply value $D_{OUT}$ is greater than the predetermined value $D_H$, the open-close solenoid valve 17 is opened, and the current supply value $D_{OUT}$ is determined by subtracting the correction current supply value $D_{ASQ}$ set at the $D_{ASQ}$ ca1culation subroutine from the calculated current supply value $D_{OUT}$. By the operation of the drive circuit 28a', the solenoid 9a of the solenoid valve 9' is supplied with the drive current having the magnitude of $D_{OUT}$. By the supply of this drive current, the solenoid valve 9' opens at a degree proportional to the magnitude of the current value $D_{OUT}$, to supply the secondary air into the intake manifold 4. When the current supply value $D_{OUT}$ is greater than the predetermined value $D_H$, the secondary air is also supplied through the open-close solenoid valve 17 by its opening, in addition to the solenoid valve 9', into the intake manifold 4, so that the amount of the supply of the secondary air becomes proportional to the current supply value $D_{OUT}$ calculated at the step 61'.

As will be appreciated from the foregoing, in the second embodiment according to the present invention, the air intake side secondary air supply system is provided with the open-close valve in an air intake side secondary air supply passage which is different from the air intake side secondary air supply passage in which the linear type solenoid valve is provided. When the current supply value for the linear type solenoid valve determined by the current control circuit is higher than the predetermined value, the open-close valve is opened and the current supply value is reduced by an amount corresponding to a flow under the condition where the open-close valve is open. In this way, the linear type solenoid valve is operated within a range in which its linearity is good, even under an engine operational range where the current supply value to the linear type solenoid valve become large. Thus, the supply of the secondary air is properly performed and the accuracy of the air/fuel ratio control is by far improved. And the efficiency of the purification of the exhaust gas is also improved as in the case of the previous embodiment.

What is claimed is:

1. An air intake side secondary air supply system for an internal combustion engine having an intake air passage with a carburetor and an exhaust gas passage, comprising:

a first air intake side secondary air supply passage leading to the intake air passage, downstream of a throttle valve of said carburetor;

a second air intake side secondary air supply passage also leading to the intake air passage, downstream of said throttle valve of said carburetor;

a first open-close valve disposed in said first air intake side secondary air supply passage;

an oxygen concentration sensor disposed in said exhaust passage and producing an output signal;

a second open-close valve disposed in said second air intake side secondary air supply passage; and duty control means responsive to said output signal of said oxygen concentration sensor and connected to said first and second open-close valves, operative to repeatedly calculate a valve open time period in a duty cycle in response to a result of determination of air/fuel ratio by using said output signal of said oxygen concentration sensor, and opening said first open-close valve during said output valve open time period in each of said duty cycles, wherein said duty control means is operative to open said second open-close valve and reducing said calculated valve open time period by a period corresponding to an amount of air flow through said second open-close valve, to reduce a period of opening of said first open-close valve, only when said calculated valve open time period is longer than a predetermined period.

2. An air intake side secondary air supply system for an internal combustion engine having an intake air passage with a carburetor, comprising:

a first air intake side secondary air supply passage leading to the intake air passage, downstream of a throttle valve of said carburetor;

a second air intake side secondary air supply passage leading to the intake air passage, downstream of said throttle valve of said carburetor;

a solenoid valve disposed in said air intake side secondary air supply passage whose opening degree is controlled by a magnitude of a drive current, to continuously vary an amount of an air intake side secondary air flowing through said air intake side secondary air supply passage;

an oxygen concentration sensor disposed in said exhaust passage and producing an output signal;

control means for determining said magnitude of said drive current of said solenoid valve, by correcting a base current value in response to a concentration of an exhaust gas component of said internal combustion engine;

current supply means for supplying said drive current to said solenoid valve whose magnitude is determined by said control means; and an open-close valve disposed in said second air intake side secondary air supply passage and connected to said control means, adapted to open only when said magnitude of said drive current of the solenoid valve is higher than a predetermined value, wherein said control means is adapted to reduce a magnitude of said drive current by a value corresponding to an amount of air flowing through said open-close valve when said magnitude of said drive current of the solenoid valve is higher than the predetermined value.

* * * * *